US007827624B1

(12) United States Patent
Cole

(10) Patent No.: US 7,827,624 B1
(45) Date of Patent: Nov. 9, 2010

(54) COMBINED CLOTHING GARMENT/AIR-COOLING DEVICE AND ASSOCIATED METHOD

(76) Inventor: David Cole, 707 Barwood Ct., Jackson, MS (US) 39212

( * ) Notice: Subject to any disclaimer, the term of this patent is extended or adjusted under 35 U.S.C. 154(b) by 67 days.

(21) Appl. No.: 12/221,748

(22) Filed: Aug. 6, 2008

Related U.S. Application Data

(60) Provisional application No. 60/964,031, filed on Aug. 9, 2007.

(51) Int. Cl.
*A41D 13/005* (2006.01)
*A41D 27/28* (2006.01)
*A41D 27/02* (2006.01)

(52) U.S. Cl. ..... 2/458; 2/69; 2/97; 2/102

(58) Field of Classification Search ..... 2/458, 2/69, 81, 97, 102, 272, DIG. 3
See application file for complete search history.

(56) References Cited

U.S. PATENT DOCUMENTS 2,759,186 A * 8/1956 Dye ..... 2/413
3,076,206 A * 2/1963 Shaw et al. ..... 441/104
3,452,812 A * 7/1969 Betts ..... 165/46
4,457,295 A * 7/1984 Roehr ..... 126/204
5,062,424 A 11/1991 Hooker
5,072,456 A * 12/1991 Elin ..... 2/94
5,140,721 A * 8/1992 Kauffeld ..... 2/2.16
5,320,164 A 6/1994 Szczesuil et al.
5,435,009 A * 7/1995 Schild et al. ..... 2/22
5,564,124 A * 10/1996 Elsherif et al. ..... 2/69
5,652,966 A * 8/1997 Reinert, Sr. ..... 2/457
5,826,274 A * 10/1998 Thompson ..... 2/69
D402,787 S * 12/1998 Kerr ..... D2/837
5,896,583 A * 4/1999 Grilliot et al. ..... 2/81
6,134,714 A * 10/2000 Uglene ..... 2/102
6,178,562 B1 * 1/2001 Elkins ..... 2/458
6,185,744 B1 2/2001 Poholski
6,349,412 B1 * 2/2002 Dean ..... 2/102
6,681,399 B1 * 1/2004 Kerr ..... 2/2.5
6,910,229 B2 * 6/2005 Raithel et al. ..... 2/456
7,017,195 B2 * 3/2006 Buckman et al. ..... 2/455
7,080,411 B2 * 7/2006 Kerr ..... 2/2.5
7,089,995 B2 8/2006 Koscheyer et al.
7,509,692 B2 * 3/2009 Elkins et al. ..... 2/458
7,565,705 B2 * 7/2009 Elkins et al. ..... 2/458
2003/0019476 A1 * 1/2003 Chambers ..... 123/438
2003/0028948 A1 * 2/2003 Chambers ..... 2/69
2003/0028949 A1 * 2/2003 Kerr ..... 2/96
2004/0177425 A1 * 9/2004 Kerr ..... 2/2.5
2006/0026732 A1 * 2/2006 Nordt et al. ..... 2/69
2006/0191063 A1 * 8/2006 Elkins et al. ..... 2/458
2006/0253950 A1 * 11/2006 Kerr ..... 2/2.5

(Continued)

*Primary Examiner*—Bobby H Muromoto, Jr.

(57) ABSTRACT

A combined clothing garment and air-cooling device may include a vest and helmet adapted to removably position about a user's body. The garments may include spaced insulation layers with an internal chamber formed therebetween. A mechanism may be included for selectively introducing air into the internal chamber. The mechanism may include entry ports in the outer layer and an air-intake vent positioned over the entry ports manually toggled open and closed. Another mechanism may be included for cooling the air within the internal chamber and channeling cooled air out. An access panel preferably has windows along its longitudinal length and may be slidably interfitted within the body and linearly displaced open and closed to permit and prohibit air from entering. A cooling agent containing dry ice may be removably contained within internal tubing for lowering air temperature.

12 Claims, 4 Drawing Sheets

U.S. PATENT DOCUMENTS

2007/0136922 A1* 6/2007 Oliver et al. ..... 2/69
2008/0067202 A1* 3/2008 Silva et al. ..... 224/148.2
2008/0222771 A1* 9/2008 Natonson et al. ..... 2/102
2008/0229484 A1* 9/2008 Baychar ..... 2/272
2009/0165183 A1* 7/2009 Kerr ..... 2/2.5
2009/0260711 A1* 10/2009 Alder et al. ..... 141/39

* cited by examiner

COMBINED CLOTHING GARMENT/AIR-COOLING DEVICE AND ASSOCIATED METHOD

CROSS REFERENCE TO RELATED APPLICATIONS

This application claims the benefit of U.S. Provisional Application No. 60/964,031, filed Aug. 9, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to personal cooling devices and, more particularly, to a combined clothing garment and air-cooling device for reducing a user body temperature during physical activity.

2. Prior Art

When the environmental temperature is below the body temperature, heat is transferred from the body through one or more heat transfer mechanisms of radiation, conduction, convection and/or evaporation of water from the body. This forces the body to conserve heat and increase heat production. When the environmental temperature is above the body temperature, heat is transferred into the body through one or more heat transfer mechanisms of radiation, conduction, and/or convection. In this situation, for example, the body uses the evaporation of perspiration from the skin and the evaporative cooling from exhaled moisture to maintain the core body temperature.

The body takes an active role in regulating the body temperature. The temperature of the body is regulated by neural feedback mechanisms that operate primarily through the hypothalmus. The hypothalmus contains not only the control mechanisms, but also the key temperature sensors. Under control of these mechanisms, sweating begins almost precisely at a skin temperature of 35 degrees C. and increases rapidly as the skin temperature rises above this value. The heat production of the body under these conditions remains almost constant as the skin temperature rises.

Different regions of the body have different abilities to transfer heat. This is based in part on both the surface area of the body region and the relative vascularization of the body region. For example, up to 40% of the body's heat is lost from the head. This is due to the large blood supply to the head, the extra surface area of the head, and from water evaporating from the nose and mouth. This proves to be particularly problematic when a person must remain in extremely hot temperatures with a covered head. Football players, military workers, and construction workers, to name a few, are often required to wear helmets or hard hats for protection, even in the most extreme temperatures. This prevents heat from escaping the body and may lead to heat stroke or other dangerous outcomes.

Clothing is used to help maintain the body core temperature. For example, additional layers of clothing are worn to help maintain body temperature in cold environments. Conversely, fewer layers of clothing are worn to help maintain body temperature in warmer environments. Regulating body temperatures due to a change in a person's activity level in these conditions is usually as simple as adding or subtracting additional layers of clothing, but in very extreme temperatures, this may not be enough to keep a body temperature down. In some situations, the person is unable to remove or add additional layers of clothing when their activity level changes. For example, people working in very hostile environments are not able to remove or add to their protective clothing and/or suits if they become too hot or cold.

U.S. Pat. No. 6,942,015 to Jenkins discloses a body heating/cooling apparatus with a vest having a front panel and a back panel defining a cavity therebetween. A flexible, continuous channel is disposed in serpentine fashion throughout the cavity and has adjacent portions. An inlet and an outlet are provided for infusing a fluid into the channel and for withdrawing the fluid from the channel. Unfortunately, this prior art's provided liquid cooling would quickly lose its low temperature and not provide a lasting cooling effect.

U.S. Pat. No. 5,438,707 to Horn discloses a body cooling garment to cool the human body. By pressurizing air or other compressible gases to a minimum pressure rating of 70 psi and channeling it by means of a tubing network that is incorporated into body garments such as a vest, head covers, and pants, the pressurized air can be transported and dispensed on the individual. Initial cooling is achieved by the cooling of the pressurized gas itself as it rapidly depressurizes and expands through openings in the tubing resulting in a very cold gas. This effect combines with the flow of air that is created by this expansion of pressurized gas in the vicinity of the body of an individual wearing such a garment to cool the user's body. Unfortunately, this prior art reference does not disclose a lasting cooling effect that would allow a user to use the device for extended periods of time without having to constantly refill the cooling member.

U.S. Pat. No. 5,539,934 to Ponder discloses an improved cooling apparatus for a protective helmet. The cooling apparatus employs hook and loop fastener strips to secure a bladder to the interior of the helmet. The bladder is filled with a breakable pouch of encapsulated ammonium salt surrounded by water. An annular chamber in the bladder allows free communication of the cooling medium within the chamber to allow for different heat loads at different areas of the bladder. Unfortunately, this prior art reference does not disclose an internal cooling mechanism within the helmet, and the hook and loop fastener system may allow the cooling device to detach at inconvenient times.

Accordingly, a need remains for a device to overcome the above-noted shortcomings. The present invention satisfies such a need by providing a device that is convenient and easy to use, lightweight yet durable in design, and designed for providing a means of reducing a user body temperature during physical activity.

BRIEF SUMMARY OF THE INVENTION

In view of the foregoing background, it is therefore an object of the present invention to provide an apparatus for reducing a user body temperature during physical activity. These and other objects, features, and advantages of the invention are provided by a combined clothing garment and air-cooling device.

In a preferred embodiment of the present invention, a combined clothing garment and air-cooling device for reducing a user body temperature during physical activity may include a vest adapted to be removably positioned about a thoracic region of the user and a helmet adapted to be removably positioned about a head region of the user. This combination allows for a more complete cooling effect on the user, as the important regions of the user's body are addressed by the device. Each of the vest and the helmet may include spaced inner and outer insulation layers configured in such a manner that an internal chamber is formed therebetween respectively.

The vest and helmet may further include an air-permeable inner layer seated within the internal chamber that may be intercalated between the inner and outer insulation layers respectively. Further, the vest and helmet may include a mechanism for selectively introducing ambient air into the internal chamber. In addition, a mechanism for cooling the ambient air within the internal chamber and thereafter channeling the cooled ambient air out from the internal chamber may be included. Such ambient air preferably has first and second temperatures prior to entering and leaving the internal chamber respectively. In this manner, normal air temperature on the outside of the device is brought into the device, cooled, and released onto the body of the user to reduce body temperature. The ambient air introducing mechanism and the ambient air cooling and channeling mechanism may be independently and simultaneously operable based upon distinct first and second user inputs. The user is thereby able to modify the flow of air into the vest and out of the interior of the vest, providing a wide range of temperature adjustments.

The ambient air introducing mechanism may include a plurality of entry ports formed through the outer insulation layer. The mechanism may also include an air-intake vent removably positioned over the entry ports and may be manually toggled between open and closed positions for permitting and prohibiting the ambient air from entering the internal chamber respectively. The vent is removable to allow a user to completely detach the vent in times when the external temperature is high and a maximum flow or air into the garment is needed.

The air-intake vent may further include an elongated body attached directly to the outer insulation layer that preferably has a plurality of openings juxtaposed along a longitudinal length of the body. Additionally, a single and unitary access panel preferably has a plurality of windows juxtaposed along a longitudinal length thereof. Such an access panel may be slidably interfitted within the body and configured in such a manner that the windows are selectively aligned and offset from the openings while the body remains statically attached to the outer insulation layer.

The access panel may be linearly displaced between open and closed positions based upon the first user input to thereby permit and prohibit the ambient air from entering through the entry ports when the windows are aligned and offset from the openings respectively. This allows a user to quickly adjust the amount of air flowing into the vest or helmet by simply sliding the access panel open or closed to comfortably set the cooling effect on the body.

The ambient air cooling and channeling mechanism may further include a plurality of flexible tubing seated within the internal chamber and oriented along non-overlapping patterns. The flexibility of the tubing along with its placement within the vest in non-overlapping patterns allows the vest to remain pliant and comfortable to wear. Also, a cooling agent may be removably contained within a first set of the tubing for lowering the first ambient air temperature to the second ambient air temperature with the first tubing set. In addition, a plurality of egress orifices may be formed in the first tubing set preferably to thereby direct the cooled ambient air outwardly from the first tubing set and into the internal chamber. The inner insulation layer may be provided with a plurality of apertures formed therein for transferring the cooled ambient air out from the internal chamber and directly onto the user respectively. Such apertures may advantageously be placed in locations of the vest or helmet where cool air is most commonly needed to provide an effective cooling process.

The combined clothing garment and air-cooling device may also include the cooling agent containing dry ice to provide a longer lasting cooling affect on the user. Dry ice provides a longer cooling effect than other similar substances and thereby allows the user to remain in higher temperatures for longer periods of time while wearing the garments. The egress orifices may permit vapor byproduct of the cooling agent to egress therefrom during sublimation, converting the cooling agent from a solid state to a vapor state. The ambient air cooling and channeling mechanism may further include a self-powered fan and a user interface preferably communicatively coupled thereto. Such a fan may be selectively toggled between on and off modes based upon receipt of the second user input such that a flow rate of the ambient air is regulated within the first tubing set.

The combined clothing garments and air-cooling device may further include the ambient air cooling and channeling mechanism preferably having an air-distribution manifold directly attached to the fan and the first tubing set preferably for selectively directing the ambient air towards user-defined target zones respectively. Additionally, a second set of the tubing preferably are attached to the entry ports and the fan for receiving and directing the ambient air downstream towards the air-distribution manifold respectively. The combined clothing garment and air-cooling device also may include the air-permeable layer preferably being perforated and formed from mesh material for prohibiting the dry ice from undesirably escaping from the orifices and thereafter passing through the apertures. The mesh prevents direct contact between the dry ice and the user's skin, thereby allowing the user to take full advantage of the powerful cooling effects of dry ice without the dangers associated with skin contact.

The combined clothing garments and air-cooling device may further include a user interface having a rotary dial electrically coupled to the air distribution manifold. The air distribution manifold may include a plurality of valves operated to control the flow of air into the first set of tubing. A user may first turn the rotary dial, such as rheostat, to select a target zone in need of cooling causing the user interface to open or close selected ones of the valves accordingly. Air may then be released from the air distribution manifold into the first set of tubing directed toward the target zone. In this manner, the user has control of which zones receive the most air flow, allowing for quicker reduction of an elevated body temperature.

It is an additional intent of the present invention to provide a method for reducing a user body temperature during physical activity. The method may include the chronological steps of first providing and removably positioning a vest about a thoracic region of the user. Second, the method may include providing and removably positioning a helmet about a head region of the user. Each of the vest and the helmet may include spaced inner and outer insulation layers configured in such a manner that an internal chamber may be formed therebetween respectively. An air-permeable inner layer may be seated within the internal chamber and may be intercalated between the inner and outer insulation layers respectively. A third step of the method preferably includes selectively introducing the ambient air into the internal chamber.

The method may further include a fifth step of cooling the ambient air within the internal chamber and thereafter channeling the cooled ambient air out from the internal chamber.

The fourth and fifth steps preferably are independently and simultaneously operable based upon distinct first and second user inputs respectively. The ambient air preferably has first and second temperatures prior to entering and leaving the internal chamber respectively. The method allows a user to remain in high heat conditions and perform physical activities that would otherwise be dangerous due to excessive temperature increases in the body.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figures 1, 2:
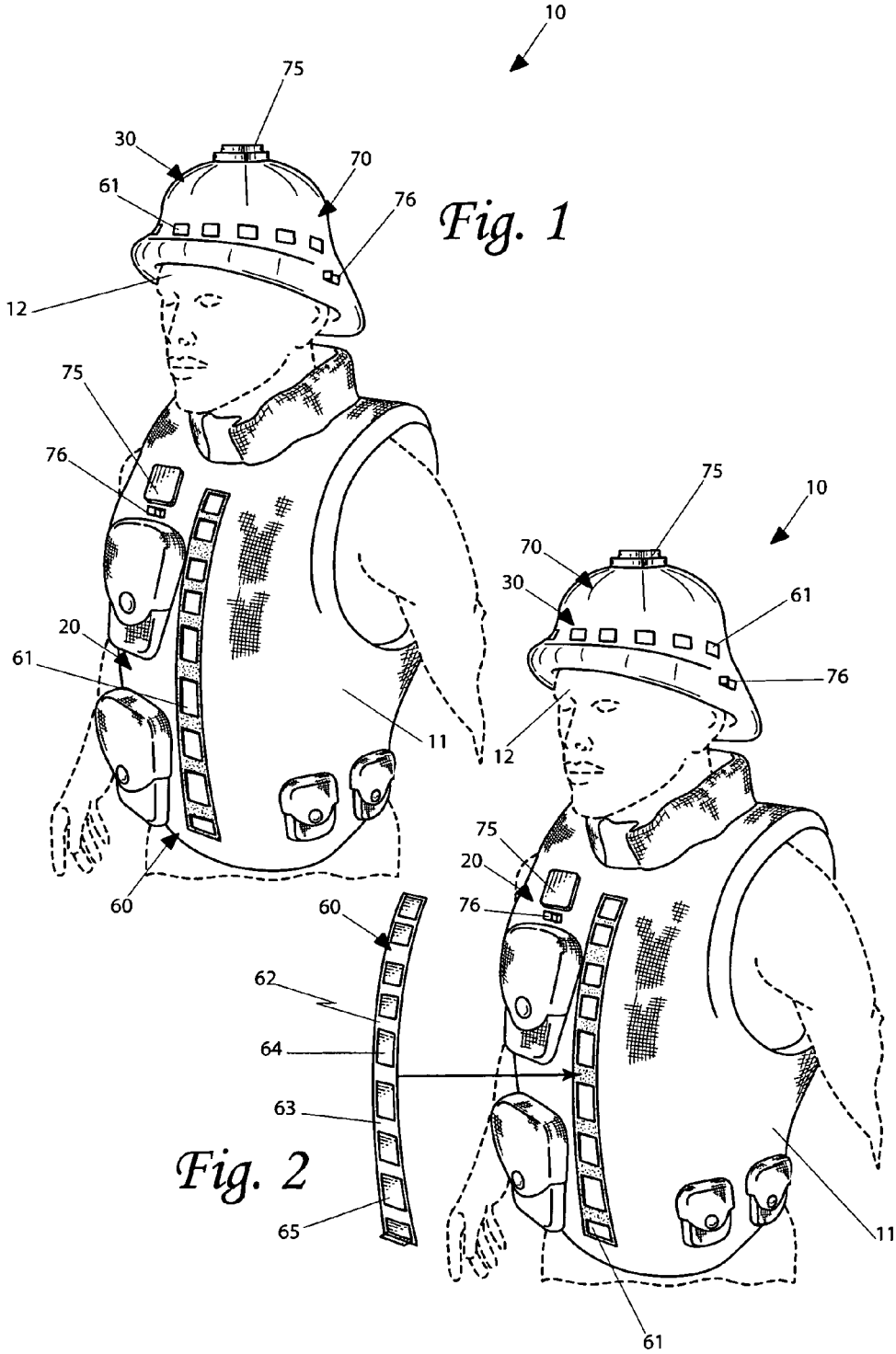
FIG. 1 is a perspective view showing a combined clothing garment and air-cooling device with the air-intake vent removed from the vest and helmet, in accordance with the present invention.
FIG. 2 is a perspective view showing the device shown in FIG. 1 with the air-intake vent removably attached to the vest with VELCRO.
Figure 3:
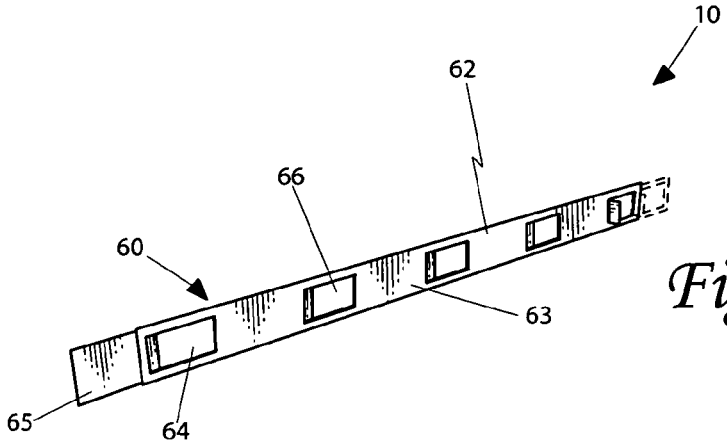
FIG. 3 is a perspective view of the air introducing mechanism showing an isolated view of the air-intake vent, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

| Reference Numeral List | |
|---|---|
| 10 | Device |
| 11 | Thoracic region |
| 12 | Head region |
| 13 | Dry ice |
| 14 | Target zones |
| 20 | Vest |
| 30 | Helmet |
| 40 | Inner insulation layer |
| 41 | Apertures on inner layer |
| 42 | Outer insulation layer |
| 43 | Air-permeable inner layer |
| 50 | Internal chamber |
| 60 | Air introducing mechanism |
| 61 | Plurality of entry ports |
| 62 | Air-intake vent |
| 63 | Vent elongated body |
| 64 | Vent plurality of openings |
| 65 | Access panel |
| 66 | Access panel windows |
| 70 | Air cooling mechanism |
| 71 | Flexible tubing |
| 72 | Cooling agent |
| 73 | First set of tubing |
| 74 | Egress orifices |
| 75 | Fan |
| 76 | User interface |
| 77 | Air distribution manifold |
| 78 | Second set of tubing |
| 80 | Rotary dial |
| 82 | Plurality of valves |

The device of this invention is referred to generally in FIGS. 1-7 by the reference numeral 10 and is intended to provide a combined clothing garment and air-cooling device for reducing a user body temperature during physical activity. It should be understood that the device 10 may be used in many different types of applications and should not be limited to work vests and hard hats, sport pads and helmets, and protective police and military gear.

Referring initially to FIGS. 1-8, a combined clothing garment and air-cooling device 10 may include a vest 20 adapted to be removably positioned about a thoracic region 11 of the user. The device 10 preferably also includes a helmet 30 adapted to be removably positioned about a head region 12 of the user. This combination provides a more complete cooling effect on the user, as the cooled air exiting the device 10 is directed to the more important regions 11, 12 of the user's body. Each of the vest 20 and the helmet 30 may include spaced inner 40 and outer 42 insulation layers configured in such a manner that an internal chamber 50 is formed therebetween respectively. The outer layer 42 of the vest 20 may be constructed of a light-weight pliable material to allow for comfortable wear, while the outer layer 42 of the helmet 30 may be constructed of a rigid material to allow the helmet 30 to retain its intended protective qualities. The vest 20 and helmet 30 may further include an air-permeable inner layer 43 seated within the internal chamber 50 and may be intercalated between the inner 40 and outer 42 insulation layers respectively.

Again referring to FIGS. 1-8, the vest 20 and helmet 30 may include a mechanism 60 for selectively introducing the ambient air into the internal chamber. In addition, a mechanism 70 for cooling the ambient air within the internal chamber 50 and thereafter channeling the cooled ambient air out from the internal chamber 50 may be included. Such ambient air preferably has first and second temperatures prior to entering and leaving the internal chamber 50 respectively. In this manner, normal air temperature on the outside of the device 10 is brought into the device 10, cooled, and released onto the user to reduce body temperature. The ambient air introducing mechanism 60 and the ambient air cooling and channeling mechanism 70 may be independently and simultaneously operable based upon distinct first and second user inputs. The user is thereby able to regulate the flow of air into the vest 20 and out of the interior of the vest 20, providing a wide range of temperature adjustments.

Referring now to FIGS. 1-4, the ambient air introducing mechanism 60 may include a plurality of entry ports 61 formed through the outer insulation layer 42. The mechanism 60 may also include an air-intake vent 62 removably positioned over the entry ports 61 that may be manually toggled between open and closed positions for permitting and prohibiting the ambient air from entering the internal chamber 50 respectively. The vent 62 is removable to allow a user to completely detach the vent 62 in times when the external temperature is high and a maximum flow of air into the device 10 is needed. Additionally, the vent 62 is preferably attached by hook and loop fasteners, although other methods may be employed as is understood by one skilled in the art. The air-intake vent 62 may further include an elongated body 63 attached directly to the outer insulation layer 42 and preferably has a plurality of openings 64 juxtaposed along a longitudinal length of the body 63.

Additionally, a single and unitary access panel 65 preferably has a plurality of windows 66 juxtaposed along a longitudinal length thereof. Such an access panel 65 may be slidably interfitted within the body 63 and configured in such a manner that the windows 66 are selectively aligned and offset from the openings 64 while the body 63 remains statically attached to the outer insulation layer 42. The access panel 65 may be linearly displaced between open and closed positions based upon the first user input to thereby permit and prohibit the ambient air from entering through the entry ports 61 when the windows 66 are aligned and offset from the openings 64 respectively. This allows a user to quickly adjust the amount of air flowing into the vest 20 or helmet 30 by sliding the access panel 65 with one smooth action to align the windows 66 with the openings 64 and entry ports 61 to comfortably set the cooling effect on the body.

Referring to FIGS. 4-7, the ambient air cooling and channeling mechanism 70 may further include a plurality of flexible tubing 71 seated within the internal chamber 50 and oriented along non-overlapping patterns. The flexibility of the tubing 71 along with its placement within the device 10 in non-overlapping patterns allows the vest 20 to maintain a thin and light-weight body and remain pliant and comfortable to wear. Also, a cooling agent 72 may be removably contained within a first set of the tubing 73 for lowering the first ambient air temperature to the second ambient air temperature with the first tubing set 73.

Figure 6:
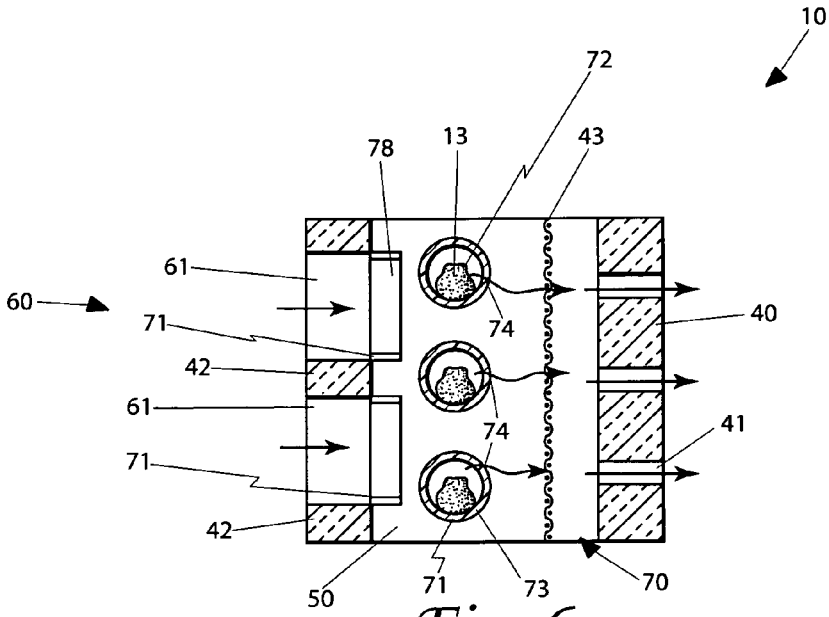
FIG. 6 is a cross-sectional view showing one travel path of ambient air through the inner and outer insulation layers of the vest.
Figure 7:
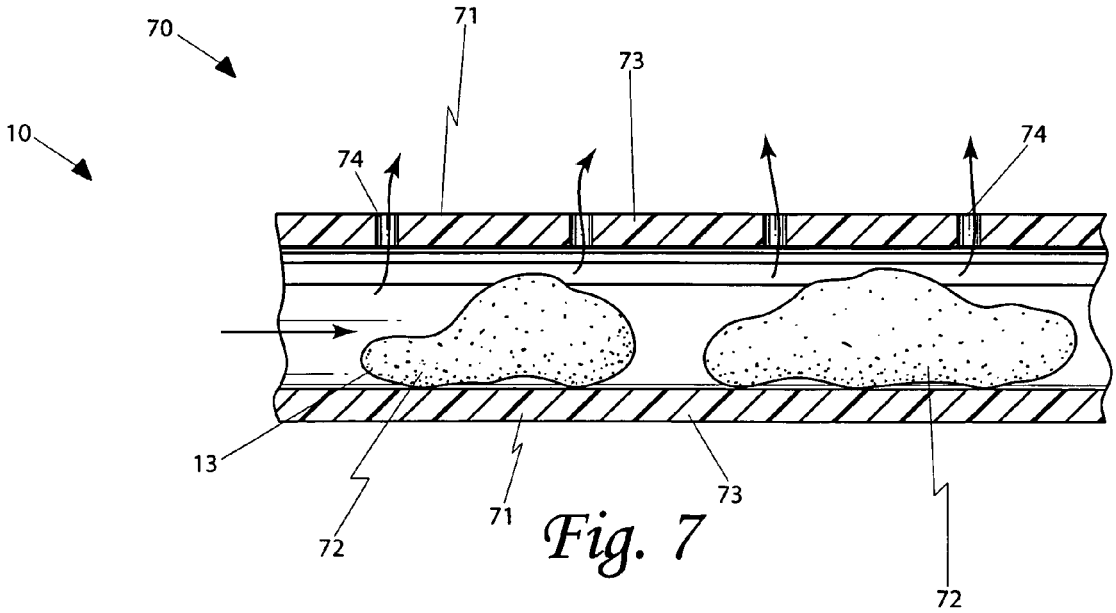
FIG. 7 is a cross-sectional view showing a first set of tubing wherein the ambient air is cooled inside such tubing by exposure to the dry ice therein.

As perhaps best shown in FIGS. 6 and 7, a plurality of egress orifices 74 may be formed in the first tubing set 73 preferably to thereby direct the cooled ambient air outwardly from the first tubing set 73 and into the internal chamber 50. The inner insulation layer 40 may be provided with a plurality of apertures 41 formed therein for transferring the cooled ambient air out from the internal chamber 50 and directly onto the user respectively. Such apertures 41 may advantageously be placed in locations of the vest 20 or helmet 30 where cool air is most commonly needed to provide an effective cooling process.

Figure 4:
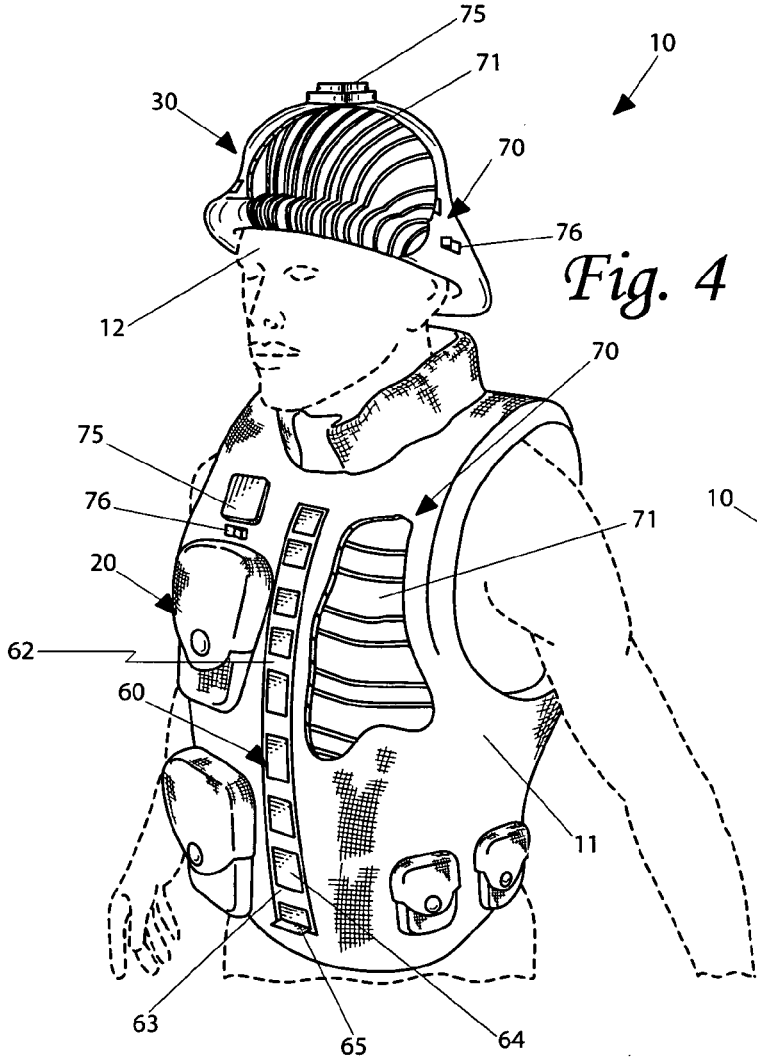
FIG. 4 is a perspective view of the device shown in FIG. 1 with a break away view showing the flexible tubing in the helmet and the vest.
Figure 5:
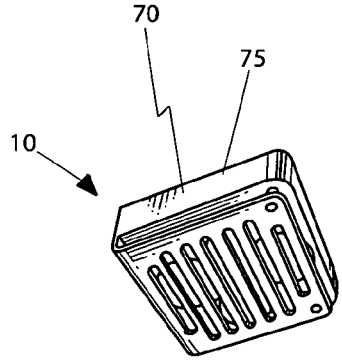
FIG. 5 is a perspective view showing an exemplary embodiment of a self-powered fan employed by the present invention.

Referring to FIGS. 4 and 5, the ambient air cooling and channeling mechanism 70 may further include a self-powered fan 75 and a user interface 76 preferably communicatively coupled thereto. Such a fan 75 may be selectively toggled between on and off modes based upon receipt of the second user input such that a flow rate of the ambient air is regulated within the first tubing set 73. The self-powered fan 75 provides a convenient means of allowing the user to remain mobile, rather than having to remain attached to an air or electric source. In an alternate embodiment, multiple fans 75 may be removably positioned on the vest 20 and may be controlled by a single user interface 76.

Referring to FIGS. 6 and 7, the combined clothing garment and air-cooling device 10 may also include the cooling agent 72 containing dry ice 13 to thoroughly cool the ambient air passing through the device 10. Dry ice 13 provides a longer cooling effect than other methods and thereby allows the user to remain in higher temperatures for longer periods of time while wearing the device 10. Of course, one skilled in the art understands that other cooling agents 72 may be employed in liquid or gas form as would allow a user to remain cool in high exterior temperatures for extended periods of time.

Additionally, the egress orifices 74 may permit vapor byproduct of the cooling agent 72 to egress therefrom during sublimation, converting the cooling agent 72 from a solid state to a vapor state. The combined clothing garment and air-cooling device 10 also may include the air-permeable layer 43 preferably being perforated and formed from mesh material for prohibiting the dry ice 13 from undesirably escaping from the orifices 74 and thereafter passing through the apertures 41. The air-permeable layer 43 prevents direct contact between the dry ice 13 and the user's skin, thereby allowing the user to take full advantage of the powerful cooling effects of dry ice 13 without the dangers associated with skin contact.

Figure 8:
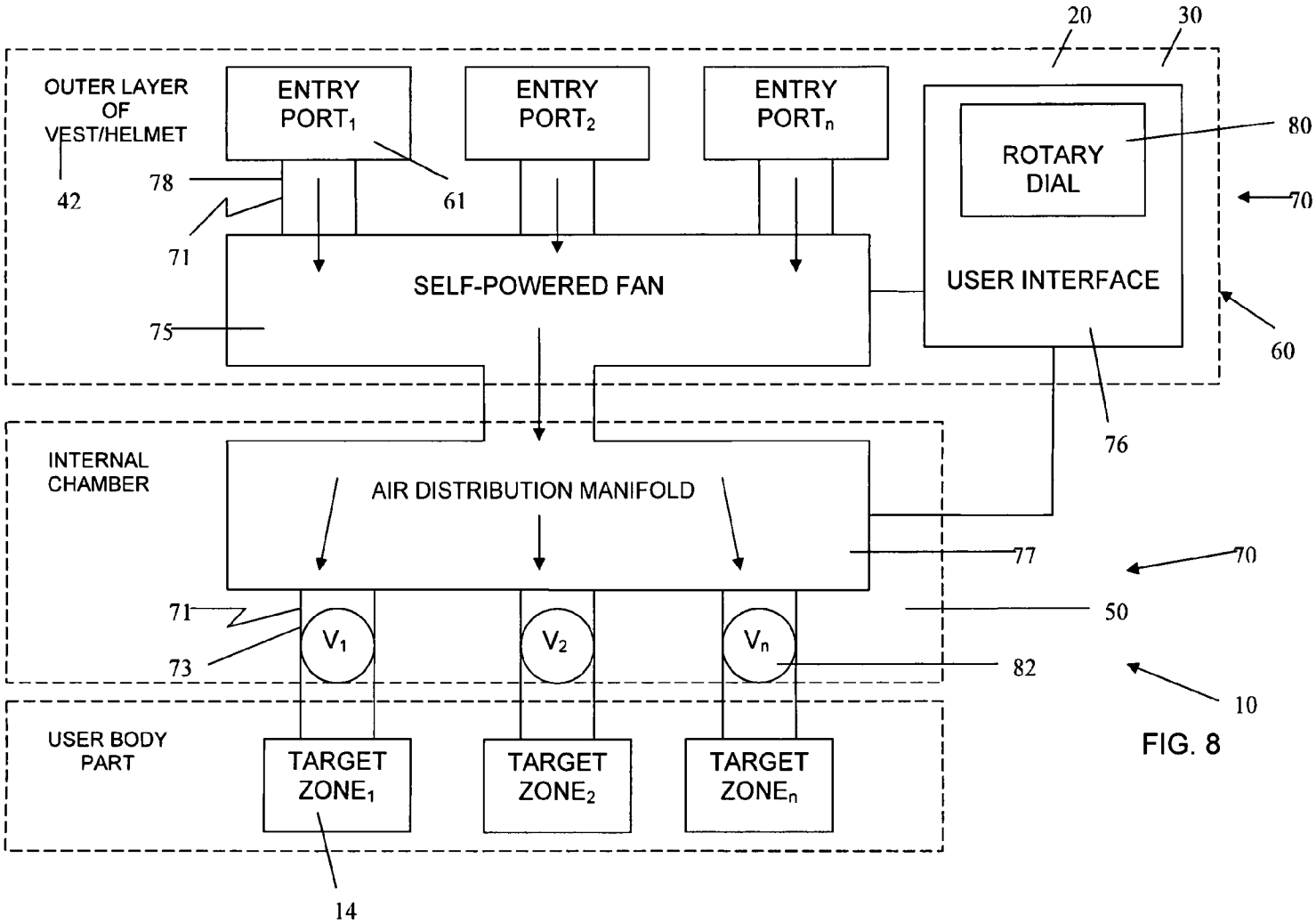
FIG. 8 is a schematic block diagram showing the interrelationship between the major components of an air cooling mechanism, in accordance with the present invention.

Referring to FIG. 8, the combined clothing garments and air-cooling device 10 may further include the ambient air cooling and channeling mechanism 70 preferably having an air-distribution manifold 77 attached directly without the use of intervening elements to the fan 75 and the first tubing set 73 preferably for selectively directing the ambient air towards user-defined target zones 14 respectively. Additionally, a second set of the tubing 78 preferably are attached to the entry ports 61 and the fan 75 for receiving and directing the ambient air downstream towards the air-distribution manifold 77 respectively. In this manner, the fan 75 may be placed in a central location and still direct cooled air to a wide area of the user's body.

Referring again to FIG. 8, the combined clothing garments and air-cooling device 10 may further include a user interface 76 having a rotary dial 80, such as a rheostat, for example, electrically coupled to the air distribution manifold 77. The air distribution manifold 77 may include a plurality of valves 82 operated to control the flow of air into the first set of tubing 73. A user may first turn the rotary dial 80 to select position corresponding to a desired target zone 14 in need of cooling, the user interface 76 may then open and close the valves 82 accordingly. Air may then be released from the air distribution manifold 77 into the first set of tubing 73 directed toward the target zone 14. In this manner, the user has control of which zones 14 receive the most air flow, allowing for quicker reduction of an elevated body temperature.

In use, a method for reducing a user body temperature during physical activity may include first step of providing and removably positioning a vest 20 about a thoracic region 11 of the user. The vest 20 is preferably light-weight and pliable, so as not to hinder the movement of the user during physical activity. The method may also include the second step of providing and removably positioning a helmet 30 about a head region 12 of the user. The outer layer 42 of the helmet 30 is preferably constructed of a solid material to protect the user from dangers encountered during physical activity. Each of the vest 20 and the helmet 30 may include spaced inner 40 and outer 42 insulation layers configured in such a manner that an internal chamber 50 may be formed therebetween respectively. An air-permeable inner layer 43 may be seated within the internal chamber 50 and may be intercalated between the inner 40 and outer 42 insulation layers respectively.

The method may further include the third step of selectively introducing the ambient air into the internal chamber 50. The method may further include the fifth step of cooling the ambient air within the internal chamber 50 and thereafter channeling the cooled ambient air out from the internal chamber 50. The fourth and fifth steps may be independently and simultaneously operable based upon distinct first and second user inputs respectively. The ambient air preferably has first and second temperatures prior to entering and leaving the internal chamber 50 respectively. The method allows a user to remain cool in high heat conditions and perform physical activities that would otherwise be dangerous, due to excessive temperature increases that would normally occur in the body.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined clothing garment and air-cooling device for reducing a user body temperature during physical activity, said combined clothing garment and air-cooling device comprising:

a vest adapted to be removably positioned about a thoracic region of the user; and a helmet adapted to be removably positioned about a head region of the user;

wherein each of said vest and said helmet comprises inner and outer insulation layers configured in such a manner that an internal chamber is formed therebetween respectively, an air-permeable inner layer seated within said internal chamber, means for selectively introducing the ambient air into said internal chamber, and means for cooling the ambient air within said internal chamber and thereafter channeling the cooled ambient air out from said internal chamber;

wherein the ambient air has first and second temperatures prior to entering and leaving said internal chamber respectively;

wherein said ambient air introducing means and said ambient air cooling and channeling means are independently and simultaneously operable based upon distinct first and second distinct user inputs;

wherein said ambient air introducing means comprises a plurality of entry ports formed through said outer insulation layer;

an air-intake vent removably positioned over said entry ports and being manually toggled between open and closed positions for permitting and prohibiting the ambient air from entering said internal chamber respectively, said air-intake vent comprising an elongated body attached directly to said outer insulation layer and having a plurality of openings juxtaposed along a longitudinal length of said body, and a single and unitary access panel having a plurality of windows juxtaposed along a longitudinal length thereof, said access panel being slidably interfitted within said body and configured in such a manner that said windows are selectively aligned and offset from said openings while said body remains statically attached to said outer insulation layer;

wherein said access panel is linearly displaced between open and closed positions based upon said first user input to thereby permit and prohibit the ambient air from entering through said entry ports when said windows are aligned and offset from said openings respectively.

2. The combined clothing garment and air-cooling device of claim 1, wherein said ambient air cooling and channeling means comprises:

a plurality of flexible tubing seated within said internal chamber and oriented along non-overlapping patterns;

a cooling agent removably contained within a first set of said tubing for lowering the first ambient air temperature to said second ambient air temperature with said first tubing set; and a plurality of egress orifices formed in said first tubing set to thereby direct the cooled ambient air outwardly from said first tubing set and into said internal chamber;

wherein said inner insulation layer is provided with a plurality of apertures formed therein for transferring the cooled ambient air out from said internal chamber and directly onto the user respectively.

3. The combined clothing garment and air-cooling device of claim 2, wherein said cooling agent comprises: dry ice;

wherein said egress orifices permit vapor byproduct of said cooling agent to egress therefrom during sublimation which converts said cooling agent from a solid state to a vapor state.

4. The combined clothing garment and air-cooling device of claim 2, wherein said ambient air cooling and channeling means comprises:

a self-powered fan; and a user interface communicatively coupled to said fan;

wherein said fan is selectively toggled between on and off modes based upon receipt of said second user input such that a flow rate of the ambient air is regulated within said first tubing set.

5. The combined clothing garment and air-cooling device of claim 4, wherein said ambient air cooling and channeling means further comprises:

an air-distribution manifold directly attached to said fan and said first tubing set for selectively directing the ambient air towards user-defined target zones respectively;

wherein a second set of said tubing are attached to said entry ports and said fan for receiving and directing the ambient air downstream towards said air-distribution manifold respectively.

6. The combined clothing garment and air-cooling device of claim 3, wherein said air-permeable layer is perforated and formed from mesh material for prohibiting said dry ice from undesirably escaping from said orifices and thereafter passing through said apertures.

7. A combined clothing garment and air-cooling device for reducing a user body temperature during physical activity, said combined clothing garment and air-cooling device comprising:

a vest adapted to be removably positioned about a thoracic region of the user; and a helmet adapted to be removably positioned about a head region of the user;

wherein each of said vest and said helmet comprises spaced inner and outer insulation layers configured in such a manner that an internal chamber is formed therebetween respectively, an air-permeable inner layer seated within said internal chamber and being intercalated between said inner and outer insulation layers respectively, means for selectively introducing the ambient air into said internal chamber, and means for cooling the ambient air within said internal chamber and thereafter channeling the cooled ambient air out from said internal chamber;

wherein the ambient air has first and second temperatures prior to entering and leaving said internal chamber respectively;

wherein said ambient air introducing means and said ambient air cooling and channeling means are independently and simultaneously operable based upon distinct first and second distinct user inputs;

wherein said ambient air introducing means comprises a plurality of entry ports formed through said outer insulation layer;

an air-intake vent removably positioned over said entry ports and being manually toggled between open and closed positions for permitting and prohibiting the ambient air from entering said internal chamber respectively, said air-intake vent comprising an elongated body attached directly to said outer insulation layer and having a plurality of openings juxtaposed along a longitudinal length of said body, and a single and unitary access panel having a plurality of windows juxtaposed along a longitudinal length thereof, said access panel being slidably interfitted within said body and configured in such a manner that said windows are selectively aligned and offset from said openings while said body remains statically attached to said outer insulation layer;

wherein said access panel is linearly displaced between open and closed positions based upon said first user input to thereby permit and prohibit the ambient air from entering through said entry ports when said windows are aligned and offset from said openings respectively.

8. The combined clothing garment and air-cooling device of claim 7, wherein said ambient air cooling and channeling means comprises:

a plurality of flexible tubing seated within said internal chamber and oriented along non-overlapping patterns;

a cooling agent removably contained within a first set of said tubing for lowering the first ambient air temperature to said second ambient air temperature with said first tubing set; and a plurality of egress orifices formed in said first tubing set to thereby direct the cooled ambient air outwardly from said first tubing set and into said internal chamber;

wherein said inner insulation layer is provided with a plurality of apertures formed therein for transferring the cooled ambient air out from said internal chamber and directly onto the user respectively.

9. The combined clothing garment and air-cooling device of claim 8, wherein said cooling agent comprises: dry ice;

wherein said egress orifices permit vapor byproduct of said cooling agent to egress therefrom during sublimation which converts said cooling agent from a solid state to a vapor state.

10. The combined clothing garment and air-cooling device of claim 8, wherein said ambient air cooling and channeling means comprises:

a self-powered fan; and a user interface communicatively coupled to said fan;

wherein said fan is selectively toggled between on and off modes based upon receipt of said second user input such that a flow rate of the ambient air is regulated within said first tubing set.

11. The combined clothing garment and air-cooling device of claim 10, wherein said ambient air cooling and channeling means further comprises:

an air-distribution manifold directly attached to said fan and said first tubing set for selectively directing the ambient air towards user-defined target zones respectively;

wherein a second set of said tubing are attached to said entry ports and said fan for receiving and directing the ambient air downstream towards said air-distribution manifold respectively.

12. The combined clothing garment and air-cooling device of claim 11, wherein said air-permeable layer is perforated and formed from mesh material for prohibiting said dry ice from undesirably escaping from said orifices and thereafter passing through said apertures.

* * * * *